US008608372B2

(12) United States Patent
Koshoji et al.

(10) Patent No.: US 8,608,372 B2
(45) Date of Patent: Dec. 17, 2013

(54) PORTABLE TIMEPIECE

(75) Inventors: Hideaki Koshoji, Chiba (JP); Kinshuro Itoh, Chiba (JP); Shuichi Suzuki, Chiba (JP)

(73) Assignee: Seiko Instruments Inc. (JP)

( * ) Notice: Subject to any disclaimer, the term of this patent is extended or adjusted under 35 U.S.C. 154(b) by 92 days.

(21) Appl. No.: 13/414,778

(22) Filed: Mar. 8, 2012

(65) Prior Publication Data

US 2012/0263023 A1 Oct. 18, 2012

(30) Foreign Application Priority Data

Mar. 13, 2011 (JP) ..... 2011-054889

(51) Int. Cl.
*G04B 37/00* (2006.01)

(52) U.S. Cl.
USPC ..... 368/308

(58) Field of Classification Search
USPC ..... 368/306–308, 281, 319–321, 286–290; 200/302.1, 302.2, 345
See application file for complete search history.

(56) References Cited

U.S. PATENT DOCUMENTS

| | | | | |
|---|---|---|---|---|
| 6,137,750 | A * | 10/2000 | Rieben | 368/290 |
| 6,200,020 | B1 * | 3/2001 | Rieben | 368/290 |
| 6,447,159 | B1 * | 9/2002 | Damasko | 368/308 |
| 6,902,169 | B2 * | 6/2005 | Wild | 277/602 |

FOREIGN PATENT DOCUMENTS

JP 2003007164 1/2003

* cited by examiner

*Primary Examiner* — Edwin A. Leon
(74) *Attorney, Agent, or Firm* — Adams & Wilks

(57) ABSTRACT

A wristwatch has a casing containing a movement. An insertion cylindrical portion of a pipe is inserted into a through-hole in a body of the casing, and the pipe is fixed to the body. A push-button has a button shaft engageable with a contact member of the movement through the pipe, and a push operation head connected to the button shaft and disposed outside the body. The button shaft has a first portion integrated with the head and a second portion screwed onto the first portion. The second portion has a diameter greater than that of the first portion and an engagement surface capable of approaching and being separated from a tip of the insertion cylindrical portion. The push-button is biased toward the outside of the body by a spring so the engagement surface is held in contact with the tip of the insertion cylindrical portion.

6 Claims, 7 Drawing Sheets

PORTABLE TIMEPIECE

BACKGROUND OF THE INVENTION

1. Field of the Invention

The present invention relates to a portable timepiece that includes a push button.

2. Description of the Related Art

In portable timepieces such as a wristwatch or a pocket watch, there is a portable timepiece that includes a push button which operates a contact of a module built in a timepiece exterior assembly. The push button is pushed, whereby, for example, in a quartz type portable timepiece, a timepiece display can be switched from an analog display to a digital display, and it is possible to switch a date and a day of week digitally displayed.

In the related art, in this kind of portable timepiece, the push button is constituted by an integral structure that is formed by a shaft portion and a head portion having a diameter greater than that of the shaft portion and provided integrally with the shaft portion, and is attached to a body of the timepiece exterior assembly by a configuration as below.

That is, the shaft portion of the push button with a waterproof packing attached to an outer peripheral portion thereof is penetrated through a pipe attached to a through hole of the body from outside the body, whereby a snap ring is attached to a shaft end portion of the push button protruded inside the body, by interposing a coils spring between a body outer end portion of the pipe and the head portion of the push button in a compressed state, the snap ring having a diameter larger than an inner diameter of the pipe is engaged with an inner end of the pipe protruded inside the body, and the push button is attached so as not to fall out to the outside of the body (see JP-A-2003-7164 (Patent Document 1)).

In the related art, since the snap ring is used so as to stop a push button formed of an integral structure to a body, an annular snap ring attachment groove is formed in a part to which the snap ring is attached in the shaft portion of the push button. As a result, strength of a thinned part is the lowest in the shaft portion of the push button.

For this reason, when a portable timepiece falls down, there is a concern that the shaft portion may be bent from the snap ring attachment groove by impact to be applied to the push button accordingly. Particularly, since a length from a tip of the shaft portion close to the contact of the movement to the snap ring attachment groove is long to the extent of a model that has a small movement and a large diameter of an hour plate, there is an increasing possibility that the shaft portion is bent. When the shaft portion is bent in this manner, even if the push button is pushed, a malfunction (hereinafter, referred to as a contact malfunction) may be caused in which the contact is not properly pushed.

Furthermore, since the snap ring is very small, the handling thereof is difficult when the same is attached to or detached from the shaft portion of the push button. In addition to this, in order to attach the snap ring to the shaft portion of the push button, there is a need to perform a work in a limited narrow space of an inner side of the body in the state in which the shaft portion is penetrated through the pipe. Thus, the attachment workability of the snap ring is bad, and by the same reason, workability of removing the snap ring from the shaft portion of the push button is also bad. In addition, when attaching and detaching the snap ring to and from the shaft portion of the push button, there is a high possibility that the snap ring, which is a small part, is lost.

In this manner, in the portable timepiece with the push button of the related art, there is a problem in that the shaft portion of the push button attached to the body is likely to be deformed by the impact, and the attachment and detachment workability of the push button to the body is bad.

SUMMARY OF THE INVENTION

In order to solve the problem, a portable timepiece of the present invention includes a module that has a contact member; a timepiece exterior assembly which has a body formed with a through hole and in which the module is accommodated; a pipe that has an insertion cylindrical portion and is fixed to the body by inserting the insertion cylindrical portion into the through hole; a push button that has a button shaft which can approach and be separated from the contact member through the pipe, and a push operation head which is continued to the shaft and is placed outside the body, in which the button shaft is formed with by screwing a second shaft portion having a diameter lager than that of a first shaft portion and having an engagement surface capable of approaching and being separated from a tip of the insertion cylindrical portion into the first shaft portion formed integrally with the head; and a biasing member which is provided so as to bias the push button toward outside the body so that the engagement surface is held in a state of coming into contact with the tip of the insertion cylindrical portion.

In the present invention, when the module is implemented as an analog type timepiece, the module indicates a movement which drives a plurality of time display needles, and when being implemented as a digital type timepiece, the module indicates an electronic circuit which drives a display showing the time or the like. In the present invention, the contact member of the module is a member for performing the switch-over of the function when being pushed by the push button, and the switch-over of the function indicates that the timepiece display is switched from an analog display to a digital display, for example, in a quartz type portable timepiece, and indicates that a date and a day of week digitally displayed are switched.

In the present invention, the first shaft portion and the second shaft portion constituting the button shaft of the push button can also be formed by a metal or a synthetic resin. In this case, the first shaft portion and the second shaft portion may be made of the same kind or the different kinds of metal, may be made of the same kind or the different kinds of synthetic resin, or one of the first shaft portion and the second shaft portion may be made of metal, and the other thereof may be made of synthetic resin. In the present invention, the connection of both shafts by the screwing of the first shaft portion and the second shaft portion can be performed by providing a male screw part in one shaft portion thereof, a female screw part in the other shaft portion thereof, and screwing the male screw part and the female screw part.

The present invention can also be applied to a portable timepiece which does not include a lock mechanism for preventing an operation miss of the push button and to a portable timepiece which includes a lock mechanism. Furthermore, in the present invention, it is possible to preferably use a coils spring in a biasing member. In the case of the portable timepiece not including the lock mechanism, the biasing member can be disposed so as to be interposed between the pipe and the head of the push button, and in the case of the portable timepiece including the lock mechanism, the biasing member can be disposed so as to be interposed between the lock member screwed with the pipe and the head of the push button.

In the present invention, a button shaft of the push button is formed of two components of a first shaft portion integrated with the head of the push button and a second shaft portion screwed with the same, and the second shaft portion having a diameter greater than that of the first shaft has an engagement surface that approaches and is separated from the tip of the insertion cylindrical portion of the pipe. For this reason, it is possible to prevent the push button biased by the biasing member from falling out to the outside of the body, by the engagement between the engagement surface and the tip of the insertion cylindrical portion. In this manner, since the falling out stop of the push button can be realized without attaching the snap ring to the button shaft of the push button, it is possible to suppress deforming of the button shaft by the impact due to the drop or the like of the portable timepiece.

Furthermore, in the present invention, as described above, the first shaft portion and the second shaft portion are screwed with each other and the button shaft is formed. For this reason, upon attaching the push button to the body, after holding the second shaft portion in the inner portion of the body in a rotation stop state, the first shaft portion is inserted into the pipe from outside the body toward the inner portion, and the first shaft portion is rotated together with the head integrated with the same, whereby it is possible to screw the first shaft portion and the second screw portion with each other to assembly the button shaft. Furthermore, after holding the second shaft portion in the inner portion of the body in the rotation stop state, by rotating the first shaft portion in the rotation direction opposite to the case of the assembly together with the head integrated with the same, it is possible to remove the screwing between the first shaft portion and the second screw portion and disassemble the push button.

In this manner, when attaching and detaching the push button to and from the body, in addition to the operation of holding the second shaft portion in the rotation stop state, there is no need for an operation of attaching or detaching the component in the inner portion of the body, and the attachment or detachment operation can be performed from outside the body where a work space is not limited. In addition to this, since the second shaft portion is much greater than the snap ring, the handling thereof is easy. Thus, it is possible to improve the attachment or detachment operability of the push button to the body.

In a preferred aspect of the present invention, at least a pair of planes is formed on a peripheral surface of the second shaft portion.

In the invention of the preferred aspect, when attaching or detaching the push button, by bringing a tool for the rotation stop into contact with the plane of the second shaft portion and interpose the second shaft portion by the tool, it is possible to easily and reliably stop the rotation of the second shaft portion in the body. For this reason, there is a further advantage in that a work of attaching or detaching the push button to or from the body can be more easily performed.

In a preferred aspect of the present invention, the tip portion of the insertion cylindrical portion is protruded into the inner portion of the body, and the engagement surface of the second shaft portion is held in contact with the tip of the insertion cylindrical portion in the body by the biasing force of the biasing member.

In the preferred invention, it is possible to increase a diameter of the engagement surface without being limited to a diameter of the through hole of the body. For this reason, there is a further advantage in that, in taking charge of the falling out stop of the push button, the engagement surface can reliably be engaged with the tip of the insertion cylindrical portion regardless of irregularity in size tolerances of the pipe and the second shaft portion.

In a preferred aspect of the present invention, the first shaft portion has a packing attachment groove in an outer peripheral portion thereof, an annular water-proof packing coming into contact with the inner peripheral surface of the insertion cylindrical portion is fitted to the packing attachment groove and is attached to the first shaft portion, the first shaft portion has a male screw part of a diameter smaller than that of the outer diameter thereof, the seconds shaft portion has a female screw part, and the first shaft portion and the second shaft portion are connected to each other by screwing the male screw part with the female screw part.

In the invention of the preferred aspect, since a shaft part of the first shaft portion thicker than the diameter of the bottom of the packing attachment groove is ensured between the packing attachment groove and the male screw part, screwing locations of the first shaft portion and the second shaft portion are away from the packing attachment groove depending on the length of the shaft part. As a result, there is a further advantage in that a location of weak strength is not formed between the packing attachment groove of the first shaft portion and the male screw part, and it is possible to suppress that the first shaft portion of the button shaft of the push button is deformed by impact due to the drop or the like of the portable timepiece.

In a preferred aspect of the present invention, the pipe has a large-diameter cylindrical portion that has a diameter larger than the insertion cylindrical portion, is integrally continued to the insertion cylindrical portion, and is placed outside the body, the head is fitted into the large-diameter cylindrical portion, and the biasing member is interposed between a cylinder bottom wall portion of the large-diameter cylindrical portion and the head in a compressed state.

In the invention of the preferred aspect, there is a further advantage in that the number of components for attaching the push button to the body is small and the configuration is simple, and thus, the push button can be easily attached or detached to or from the body.

In a preferred aspect of the present invention, the pipe is placed outside the through hole so as to be integrally continued to the insertion cylindrical portion, and has a male screw cylindrical portion formed with a male screw in an outer periphery thereof, the pipe further includes a lock member that is disposed over a button release position which is screwed with the male screw cylindrical portion movably along an axial direction of the pipe and comes into contact with the body and a button restriction position which comes into contact with the head, the lock member has a cover cylindrical portion that covers a peripheral surface of the head in the button restriction position, and the biasing member is interposed between the head and the lock member in a compressed state.

In the invention of the preferred aspect, by placing the lock member in the button restriction position, it is possible to prevent that the push button is carelessly pushed and erroneously operated. Along with this, even when the lock member is further rotated and force is applied to the push button in a direction falling out from the body, in the state of placing the lock member in the button restriction position, along with this, the second shaft portion having the engagement surface engaged with the tip of the insertion cylindrical portion of the pipe is not deformed, and the second shaft portion does not enter the tip portion of the insertion cylindrical portion. For this reason, there is a further advantage in that it is possible to ensure an operation reliability of the push button in the state of returning the lock member to the button release position.

According to the portable timepiece of the present invention, it is possible to expect an effect which can suppress the deformation of the button shaft of the push button attached to the body by impact, and the attachment or detachment work of the push button to the body can easily be performed.

DETAILED DESCRIPTION OF THE PREFERRED EMBODIMENTS

Hereinafter, a first embodiment of the present invention will be described with reference to FIGS. 1 to 3 in detail.

Figure 1:
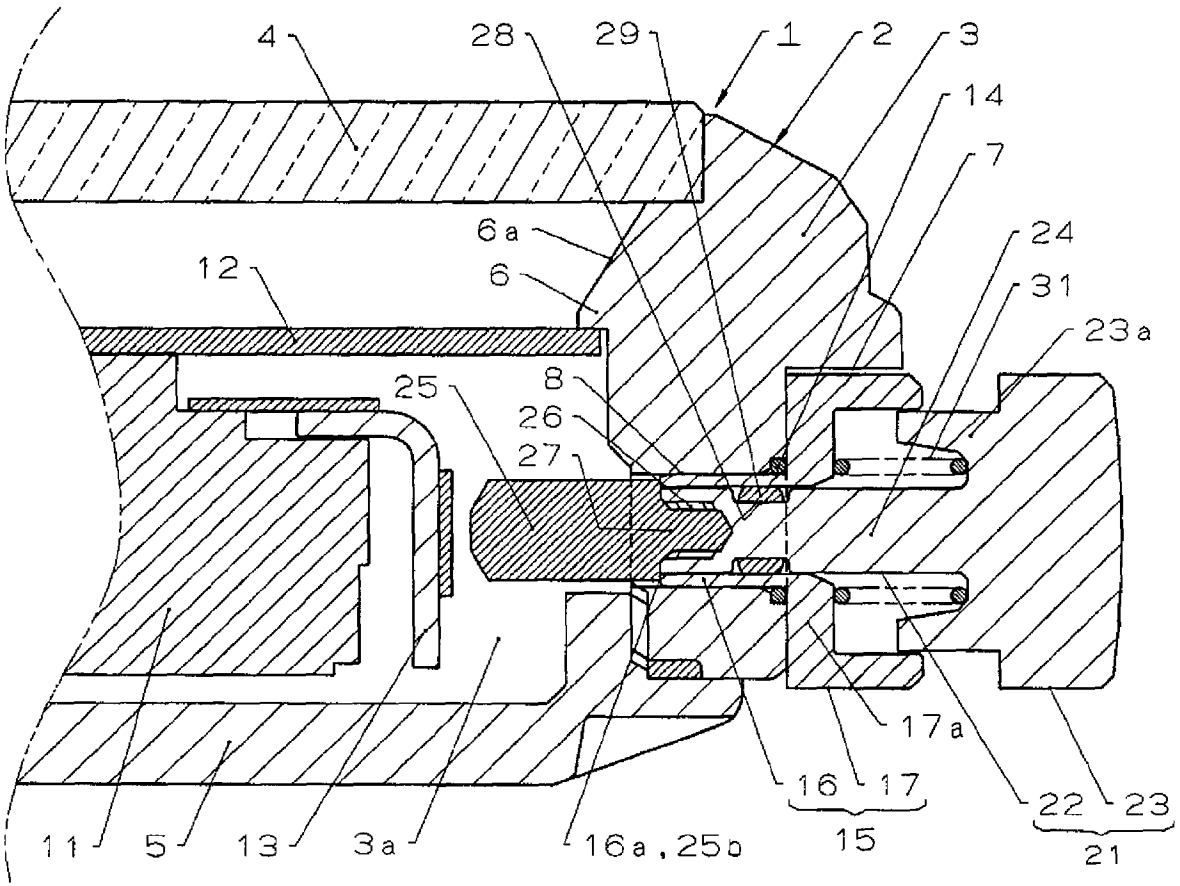
FIG. 1 is a cross-sectional view that shows a part of a wristwatch according to a first embodiment of the present invention.

Reference numeral 1 in FIG. 1 shows a portable timepiece, for example, a wristwatch. In a timepiece exterior assembly 2 included in the wristwatch 1, a module, for example, a movement 11, an hour plate 12, a time display needle (not shown) such as an hour hand, a minute hand, and a second minute or the like are housed. The movement 11 driving the time display need has a contact member 13 constituted by a plate spring or the like. The contact member 13 is pushed by a push button described later, whereby the function of the movement 11 is switched.

As shown in FIG. 1, a cover glass 4 capable of seeing through the hour plate 12 is mounted on one surface (an upper surface) of a thickness direction of a body 3 formed by a metal such as a stainless steel or titanium in a ring shape in a liquid tight manner, and a back cover 5 made of a metal such as a. stainless steel or titanium is mounted on the other surface (a lower surface) of the body 3 in the thickness direction in a liquid-tight manner, whereby the timepiece exterior assembly 2 is formed.

The body 3 has a clearance portion 6 that covers a peripheral portion upper surface of the hour plate 12. The clearance portion 6 shown in FIG. 1 is integrally formed in an upper inner periphery of the body 3 but may be a ring-shaped member that is molded separately from the body 3. The clearance portion 6 has an inner peripheral slope surface 6*a* in which an open diameter thereof is formed so as to be narrowed as going toward the downside, and the inner peripheral slope surface 6*a* faces a peripheral portion back surface of the cover glass 4.

A watch stem (not shown) is attached to the body 3. The body 3 has a through hole 8 through which a concave portion 7 communicates with an inner portion 3*a* of the body 3 in a position deviated from the watch stem.

The concave portion 7 is provided so as to be opened to an outer peripheral surface and a lower surface of the body 3, respectively. The concave portion 7 is not essential and can be omitted, but the concave portion 7 is provided so as to cover and protect a large-diameter cylindrical portion 17 described later to be accommodated therein by the body 3.

The through hole 8 is directly provided along a radial direction of the body 3. One end of the through hole 8 is opened to an inner portion 3*a* of the body 3, and the other end of the through hole 8 is opened to an approximately central portion of a bottom surface of the concave portion 7.

Figure 2:
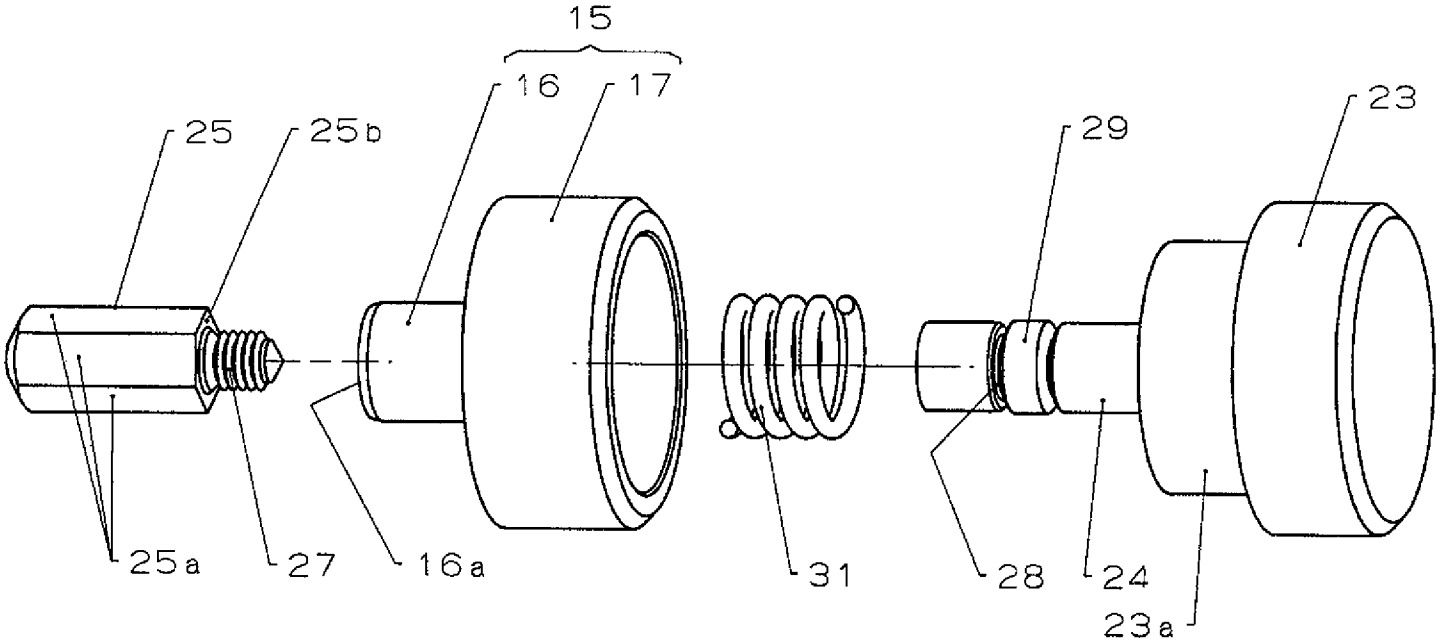
FIG. 2 is an exploded perspective view that shows a push button included in the wristwatch of FIG. 1 and components therearound.
Figure 3:
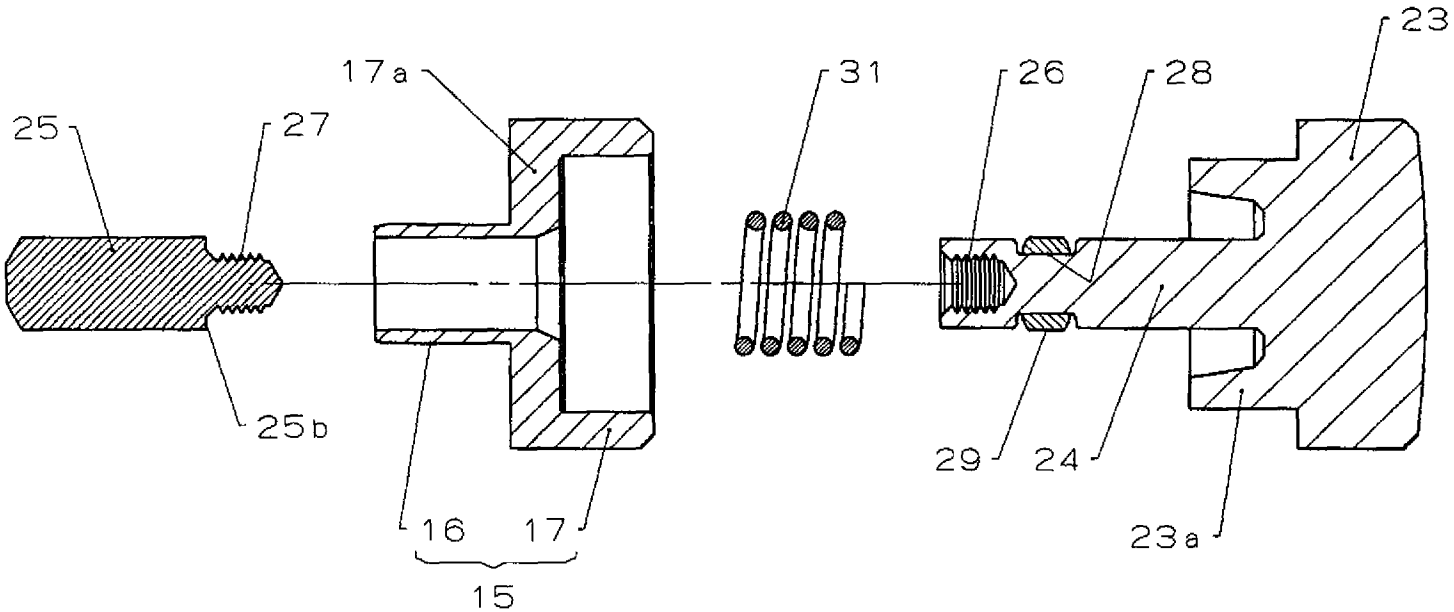
FIG. 3 is an exploded perspective view that shows a push button included in the wristwatch of FIG. 1 and components therearound.

Reference numeral 15 in FIGS. 1 to 3 indicates a pipe. The pipe 15 is made of a metal, for example, a stainless steel, has an insertion cylindrical portion 16 and a large-diameter cylindrical portion 17 having a diameter larger than that, and is formed in a stepped cylindrical shape. The large-diameter cylindrical portion 17 has a cylinder bottom wall portion 17*a*, and the cylinder bottom wall portion 17*a* is integrally continued to the insertion cylindrical portion 16.

The pipe 15 is fixed to the body 3 through welding by inserting the insertion cylindrical portion 16 into the through hole 8 and housing the large-diameter cylindrical portion 17 in the concave portion 7. A metallic solder material 14 taking charge of the fixing is shown in FIG. 1. The solder material 14 is provided in a corner portion that is constituted by a cylinder bottom wall portion 17*a* coming into contact with the bottom surface of the concave portion 7 and the insertion cylindrical portion 16 coming into contact with the surface forming the through hole 8 of the body 3, and takes charge of the waterproof between the pipe 15 and the body 3. For example, a length of the insertion cylindrical portion 16 of the pipe 15 is shorter than an overall length of the through hole 8. For that reason, a tip 16*a* of the insertion cylindrical portion 16 is situated in the through hole 8 and does not reach the inner portion 3*a* of the body 3. The large-diameter cylindrical portion 17 placed in the concave portion 7 of the outside of the body 3 is opened to the outside of the body 3.

A push button 21 to be pressed from the outside of the body 3 toward the inner portion 3*a* of the body 3 is attached to the body 3 through the pipe 15. The push button 21 is formed to have a button shaft 22 and a head 23.

The button shaft 22 is, for example, made of a metal and has a length penetrating through the pipe 15. The button shaft 22 is formed by screwing the first shaft portion 24 with the second shaft portion 25. For the screwing, a female screw part 26 worked in a hole opened to an end surface thereof is provided in a tip portion of the first shaft portion 24, and a male screw part 27 is provided in the second shaft portion 25. By screwing the female screw part 26 with the male screw part 27, the first shaft part 24 is connected to the second shaft part 25, and the button shaft 22 is formed.

A diameter of the first shaft portion 24 is slightly smaller than an inner diameter of the insertion cylindrical portion 16 of the pipe 15. A packing attachment groove 28 continued in a circumferential direction is formed near a tip of the first shaft portion 24, and an annular water-proof packing 29 is provided so as to be fitted to the packing attachment groove 28. The water-proof packing 29 is formed of a material that can be elastically deformed and can slide along an inner surface of the insertion cylindrical portion 16.

A portion except for the male screw part 27 of the second shaft portion 25 forms, for example, a short hexagonal rod shape. For that reason, the second shaft portion 25 three sets of two planes 25*a* (only three of them are shown in FIG. 2) parallel to each other on a peripheral surface thereof. An outer diameter (in this case, the same indicates a diameter of a circle that can be drawn adjacent to a ridge forming a boundary of the plane 25*a* adjacent to the circumferential direction) of the second shaft portion 25 is greater than an inner diameter of the pipe 15 and a diameter of the first shaft portion 24, and is smaller than an outer diameter of the pipe 15.

The second shaft portion 25 has an engagement surface 25*b*. The engagement surface 25*b* is formed in a surface perpendicular to an axial direction of the second shaft portion 25, and the male screw part 27 is protruded in a central portion of the engagement surface 25*b*. The engagement surface 25*b* is continued in the tip of the first shaft portion 24 so as to be projected from this to the outside so that a step is formed between the first shaft portion 24 and the second shaft portion 25 in the state in which the first shaft portion 24 is connected to the second shaft portion 25.

In an end of an opposite side of the end portion of the first shaft portion 24 screwed with the second shaft portion 25, a head 23 is integrally continued which is operated for the pressing operation of the push button 21 toward the inner portion 3*a* of the body 3. The head 23 has a diameter greater than that of the button shaft 22 and has a fitting cylindrical portion 23*a*. The fitting cylindrical portion 23*a* is integrally protruded from the head 23 toward the second shaft portion 24, and the outer diameter of the fitting cylindrical portion 23*a* is slightly smaller than the inner diameter of the large-diameter cylindrical portion 17.

The push button 21 attached to the body 3 is biased toward the outside of the body 3 by a biasing member, for example, a coil spring 31. The coil spring 31 has a diameter that is greater than that of the first shaft portion 24 and is smaller than that of the fitting cylindrical portion 23*a*. The coil spring 31 enters a compressed state and is interposed by the cylinder bottom wall portion 17*a* of the pipe 15 and the head 23.

By spring force (biasing force) of the coil spring 31, the push button 21 is held in the state (an engaged state) in which the engagement surface 25*b* comes into contact with the tip 16*a* (see FIGS. 1 and 3) of the insertion cylindrical portion 16 from the inner portion 3*a* of the body 3. In this manner, in the holding state of the push button 21, the tip of the button shaft 22, in other words, the tip of the second shaft portion 25 closes to the contact member 13 with a predetermined gap formed therebetween.

The push button 21 is attached to the body 3 in a sequence as below.

Firstly, after the water-proof packing 29 is fitted and attached to the packing attachment groove 28 of the first shaft portion 24, the coil spring 31 is fitted to the first shaft portion 24. Next, the button shaft 22 is penetrated through the insertion cylindrical portion 16 of the pipe 15 fixed to the through hole 8 of the body 3, while assembling the button shaft 22 to the body 3 to which the back cover 5 is not attached. in this case, the second shaft portion 25 is placed in the inner portion 3*a* of the body 3 by the use of a tool (not shown) which interposes the second shaft portion 25 in the radial direction thereof so that the male screw part 27 of the second shaft portion 25 is situated in the insertion cylindrical portion 16. Along with this, the first shaft portion 24 is inserted from the outside of the body 3 into the insertion cylindrical portion 16. In this state, the first shaft portion 24 is rotated in a predetermined direction together with the head 23, and the female screw part 26 and the male screw portion 27 of the second shaft portion 25 are screwed with each other. Otherwise, after inserting the first shaft portion 24 in the insertion cylindrical portion 16, the second shaft portion 25 is placed in the body 3 by the use of the tool, then, the first shaft portion 24 and the head 23 are rotated in a predetermined direction, and the female screw part 26 is screwed with the male screw part 27. In addition, the first shaft portion 24 is inserted into the insertion cylindrical portion 16, and along with this, the water-proof pacing 29 is compressed and comes into close contact with the inner surface of the insertion cylindrical portion 16.

At the time of the assembling, since the tool comes into contact with the plane 25*a* of the second shaft portion 25 and interposes the second shaft portion 25 in the radial direction, the rotation of the second shaft portion 25 is stopped in the body 3. In addition, in this case, the second shaft portion 25 is interposed by the tool in the radial direction while coming into contact with two planes 25*a* parallel to each other, reliability of the rotation stop is high. In this manner, the rotation stop of the second shaft portion 25 is reliable, and along with this, it is possible to more easily perform a work of screwing the first shaft portion 24 with the second shaft portion 25. Furthermore, since the rotation stop of the second shaft portion 25 by the tool is reliable, from the same reason, in disassembling the button shaft 22, it is also possible to easily perform a work of removing the screwing between the first shaft portion 24 and the second shaft portion 25.

The female screw part 26 and the male screw part 27 are screwed with each other in the order mentioned above, whereby the first shaft portion 24 and the second shaft portion 25 are connected to each other, and the button shaft 22 penetrating through the insertion cylindrical portion 16 is assembled.

In the state in which the push button 21 is attached to the body 3 in this manner, since the coil spring 31 interposed between the cylinder bottom wall portion 17*a* of the large-diameter cylindrical portion 17 of the pipe 15 and the head 23 is held in the axially compressed state, the push button 21 is biased in a direction falling out to the outside of the body 3 by the spring force of the coil spring 31. As a result, the push button 21 is moved so that a part of the first shaft portion 24 side of the second shaft portion 25 is drawn into the through hole 8, and the engagement surface 25*b* is held in the engaged state hooked to the tip 16*a* of the insertion cylindrical portion 16. Along with this, the head 23 is placed outside the body 3, and the fitting cylindrical portion 23*a* is fitted into the large-diameter cylindrical portion 17 of the pipe 15 so as to cover the first shaft portion 24 and the coil spring 31.

In this manner, the pipe 15 of the wristwatch 1 has the large-diameter cylindrical portion 17 that has a diameter greater than that of the insertion cylindrical portion 16 and is placed outside the body 3 so as to be integrally continued to the insertion cylindrical portion 16, the head 23 of the push button 21 is fitted into the large-diameter cylindrical portion 17, and the coil spring 31 is interposed between the cylinder bottom wall portion 17*a* of the large-diameter cylindrical portion 17 and the head 23 in a compressed state. For this reason, the number of component for attaching the body 3 to the push button 21 is small and the configuration is simple, and thus, it is possible to easily attach or detach the push button 21 to or from the body 3 in the order described above.

It is possible to perform the attachment or detachment operation of the push button 21 from the outside of the body 3 without a need for an operation for attaching or detaching the component to or from the inner portion 3*a* of the body 3, in addition to the operation of holding the second shaft portion 25 in the rotation stop state by the use of the tool as is evident from the order described above. In addition, since the second shaft portion 25 is much greater than the snap ring, the handling thereof is easy, and a risk of loss during working is also less. Thus, it is possible to improve the attachment and detachment workability of the push button 21 to the body 3.

However, the assembly including the movement 11, the hour plate 12 attached thereto, a time display needle (not shown) or the like is integrated to the body 3 to which the back cover 5 is not attached, through an opening closed by the back cover 5. In this case, the assembly is positioned by the contact of the peripheral portion of the hour plate 12 with the back surface (the lower surface) of the clearance portion 6 of the body 3.

It is also possible to perform the attachment work of the push button 21 before the integration of the assembly. However, as described above, in the attachment of the push button 21, there is almost no work in the inner portion 3*a* of the body 3, but the insertion and rotation works from the outside of the body 3, where the working space is not limited by the body 3, is the most part, and thus, the push button 21 can be attached after the integration of the assembly to the body 3. In this manner, in the case of attaching the push button 21 to the body 3 after the assembly, even when the length of the second shaft portion 25 protruded to the inner portion 3*a* of the body 3 is long, the second shaft portion 25 and the hour plate 12 do not interfere with each other and the accommodation of the assembly into the body 3 is not disturbed, and thus, the case is preferable in that the assembly can easily be mounted in the body 3.

As shown in FIG. 1, when the push button 21 of the assembled wristwatch 1 is pushed against the coil spring 31 by fingers of a user accompanied to the head 23, the engagement surface 25*b* of the button shaft 22 is separated from the tip 16*a* of the insertion cylindrical portion 16, and the second shaft portion 25 of the button shaft 22 comes into contact with the contact member 13 of the movement 11, thereby switching the function. Furthermore, when the pushed force of the push button 21 is released, the push button 21 is pushed back toward the outside of the body 3 by the spring force of the coil spring 31. As a result, the second shaft portion 25 of the button shaft 22 is separated from the contact member 13, the engagement surface 25*b* of the button shaft 22 comes into contact with the tip 16*a* of the insertion cylindrical portion 16, and the push button 21 is held in the fallen out state.

Furthermore, as mentioned above, the button shaft 22 of the push button 21 is not an integrated structure, but is formed by two components including the first shaft portion 24 integrated with the head 23 of the push button 21 and the second shaft portion 25 screwed therewith, and the second shaft portion 25 having the diameter greater than that of the first shaft portion 24 has the engagement surface 25*b* which comes into contact with and is separated from the tip 16*a* of the insertion cylindrical portion 16 of the pipe 15. As a result, it is possible to prevent that the push button 21 biased to the outside of the body 3 by the coil spring 31 falls out of the body 3, by the contact between the engagement surface 25*b* and the tip 16*a* of the insertion cylindrical portion 16, without attaching the snap ring to the button shaft 22 of the push button 21.

Along with this, in realizing the falling out stop of the push button 21, since the button shaft 22 has not a groove for the snap ring attachment causing a decrease in strength thereof, shock resistance of the button shaft 22 is improved. As a result, the movement 11 is small, and even in the case of the wristwatch 1 of a configuration having a long length from the inner surface of the body 3 to the tip of the button shaft 22, when the wristwatch 1 accidently falls, it is possible to suppress that the button shaft 22 of the push button 21 is deformed and bent by the accompanying impact. Thus, there is no concern than the faulty contact operation caused by the bending of the button shaft 22 occurs, the contact member 13 is properly pushed along with the pushing of the push button 21, whereby the function of the wristwatch 1 can be switched.

Furthermore, since the push button 21 is formed by two members as described above, when the head 23 is made of a precious metal to increase decorativeness of the wristwatch 1, only the first shaft portion 24 and the head 23 instead of the whole push button 21 may be made of a precious metal, and the second shaft portion 25 may be formed of anther cheap metal or a synthetic resin. For this reason, it is possible to increase the decorativeness of the wristwatch 1 while reducing the used amount of the precious metal of a high material cost.

In addition, since the push button 21 is formed by two members, there is an advantage as below in manufacturing the wristwatch 1. That is, since the size of the movement 11 differs depending on the model of the wristwatch 1, the push button 21 having the button shaft 22 of the suitable length for each model is used. In this case, by preparing the second shaft portions 25 of the different lengths for each model of the wristwatch 1, selecting the second shaft portion 25 of a length suitable for the model among them, and screwing the same with the first shaft portion 24, it is possible to form the push button 21 having the button shaft 22 of the suitable length for each model. For this reason, there is an advantage in manufacturing in that it is possible to form the first shaft portion 24 and the head 23 molded integrally with the same as a common component, and an inventory management of the component can easily be performed.

Figure 4:
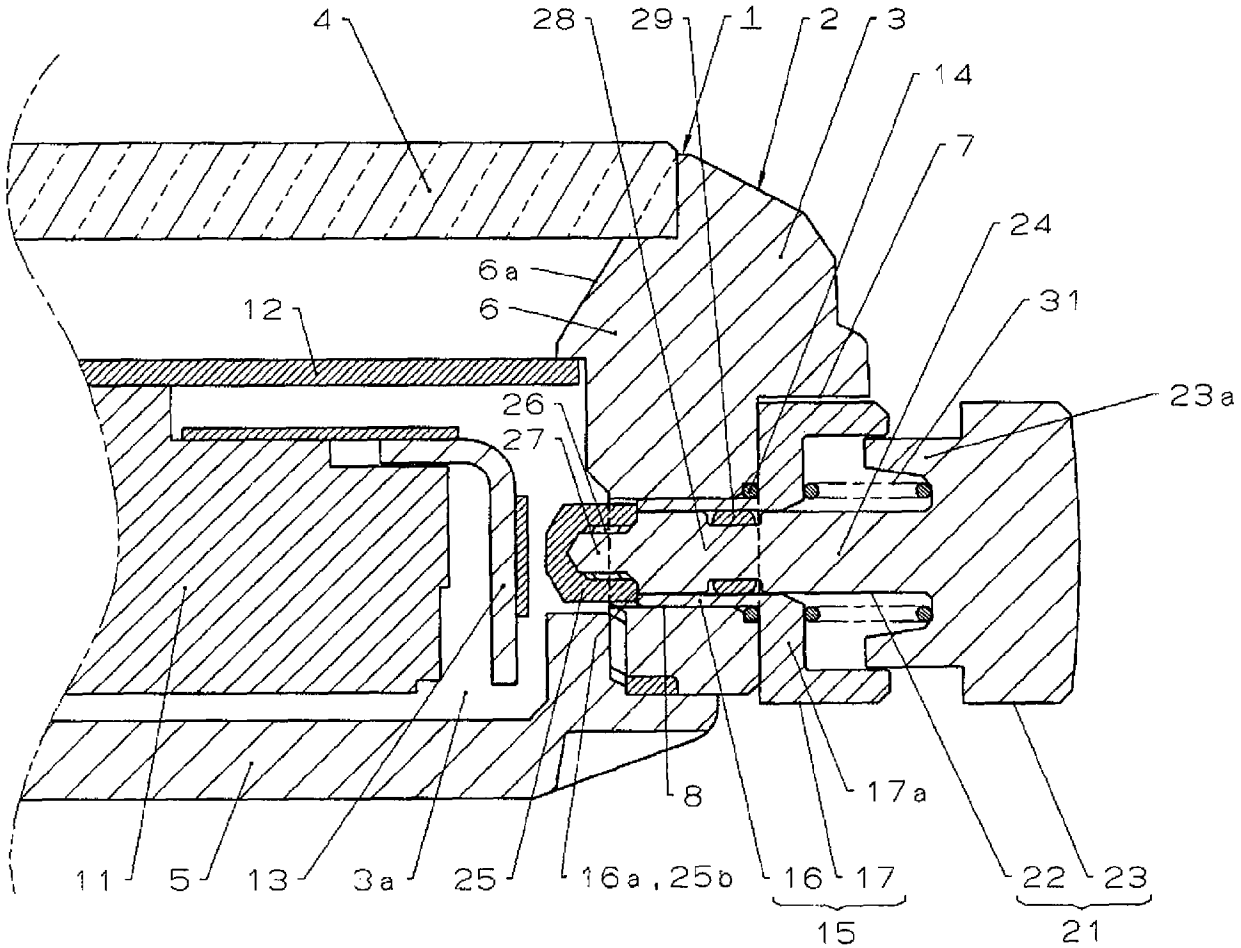
FIG. 4 is a cross-sectional view that shows a part of a wristwatch according to a second embodiment of the present invention.
Figure 5:
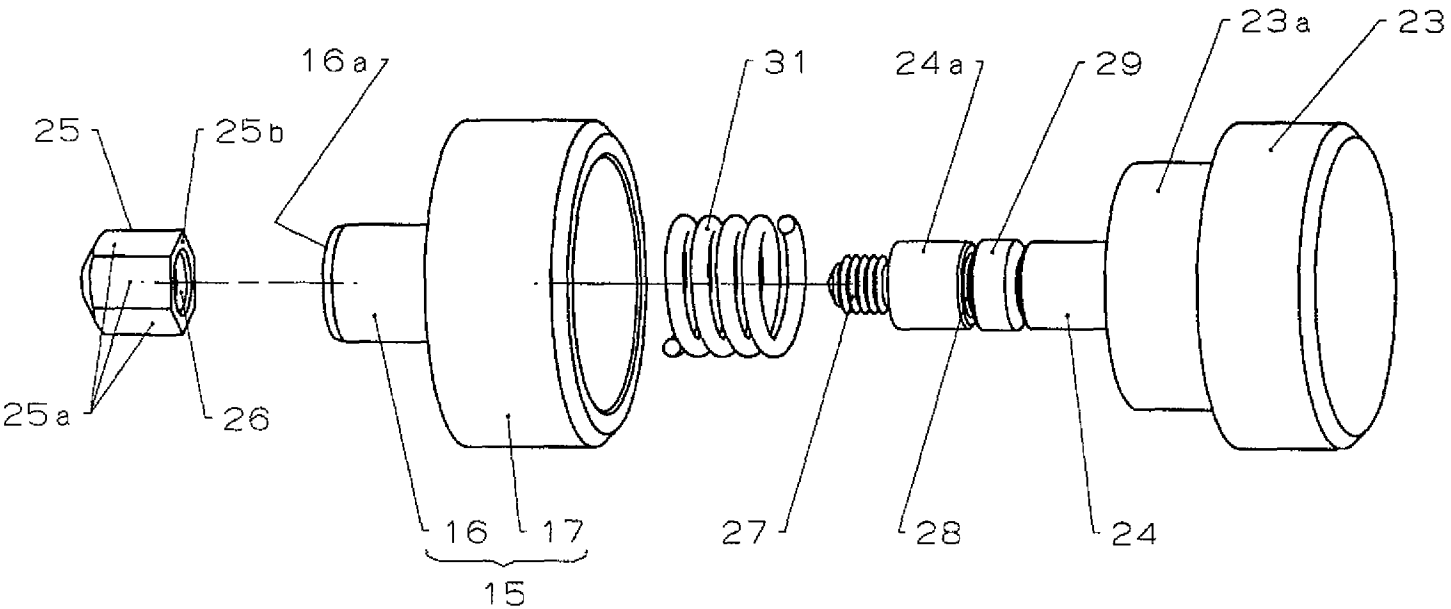
FIG. 5 is an exploded perspective view that shows a push button included in the wristwatch of FIG. 4 and components therearound.

FIGS. 4 and 5 show a second embodiment of the present invention. A wristwatch according to the second embodiment is identical to the first embodiment except for a configuration described below. For that reason, the same configurations as the first embodiment are denoted by the same reference numerals as the first embodiment, and the descriptions thereof will be omitted.

In the second embodiment, the male screw part 27 is provided in the first shaft portion 24 of the button shaft 22. The male screw part 27 has a diameter smaller than the outer diameter of the first shaft portion 24, forms the tip of the first shaft portion 24, and is provided so as to be protruded in a direction away from the packing attachment groove 28. Furthermore, the female screw part 26 is provided in the second shaft portion 25 of the button shaft 22. The male screw part 27 and the female screw part 26 are screwed with each other, the first shaft portion 24 and the second shaft portion 25 are connected to each other, and the button shaft 22 of the push button 21 is formed. Additionally, the diameter of the movement 11 is greater than that of the movement of the first embodiment, and the length of the second shaft portion 25 is shorter than that of the second shaft portion 25 of the first embodiment. Along with this, the plane 25*a* is provided only one location of the outer periphery of the second shaft portion 25.

The configurations except for those described above are the same as the first embodiment. For that reason, in the second embodiment, by the same reason as described in the first embodiment in advance, the same action as the first embodiment is obtained, and the problem of the present invention can be solved. That is, it is possible to provide the wristwatch 1 in which it is possible to suppress that the button shaft 22 of the push button 21 attached to the body 3 is deformed by impact, and it is possible to easily perform the attachment or detachment work of the push button 21 to or from the body 3.

Furthermore, in the second embodiment, since the first shaft portion 24 has the male screw part 27 that is screwed with the female screw part 26 of the second shaft portion 25, a shaft part 24*a* of the first shaft portion 24 thicker than the diameter of the bottom of the packing attachment groove 28 is present between the packing attachment groove 28 and the male screw part 27 in the first shaft portion 24. For this reason, the screwing location between the first shaft portion 24 and the second shaft portion 25 is away from the packing attachment groove 28 depending on the length of the shaft part 24*a*, and a location of weak strength is not formed between the packing attachment groove 28 of the first shaft portion 24 and the female screw part 26. Thus, it is possible to suppress that the first shaft portion 24 of the button shaft 22 is deformed by impact due to the drop of the wristwatch 1 or the like.

Figure 6:
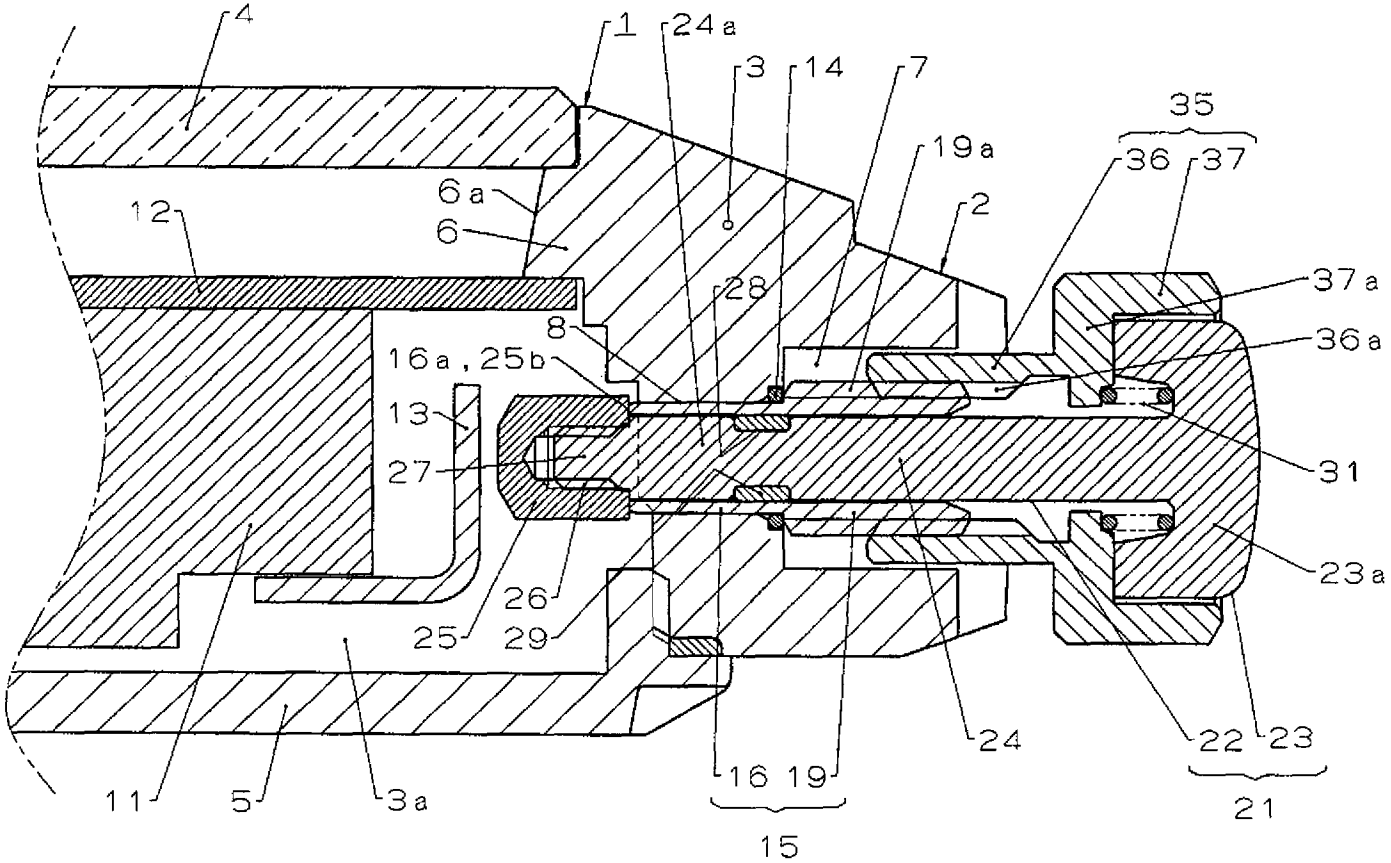
FIG. 6 is a cross-sectional view that shows a part of wristwatch according to a third embodiment of the present invention in a state in which a push button is placed in a button restriction position.
Figure 7:
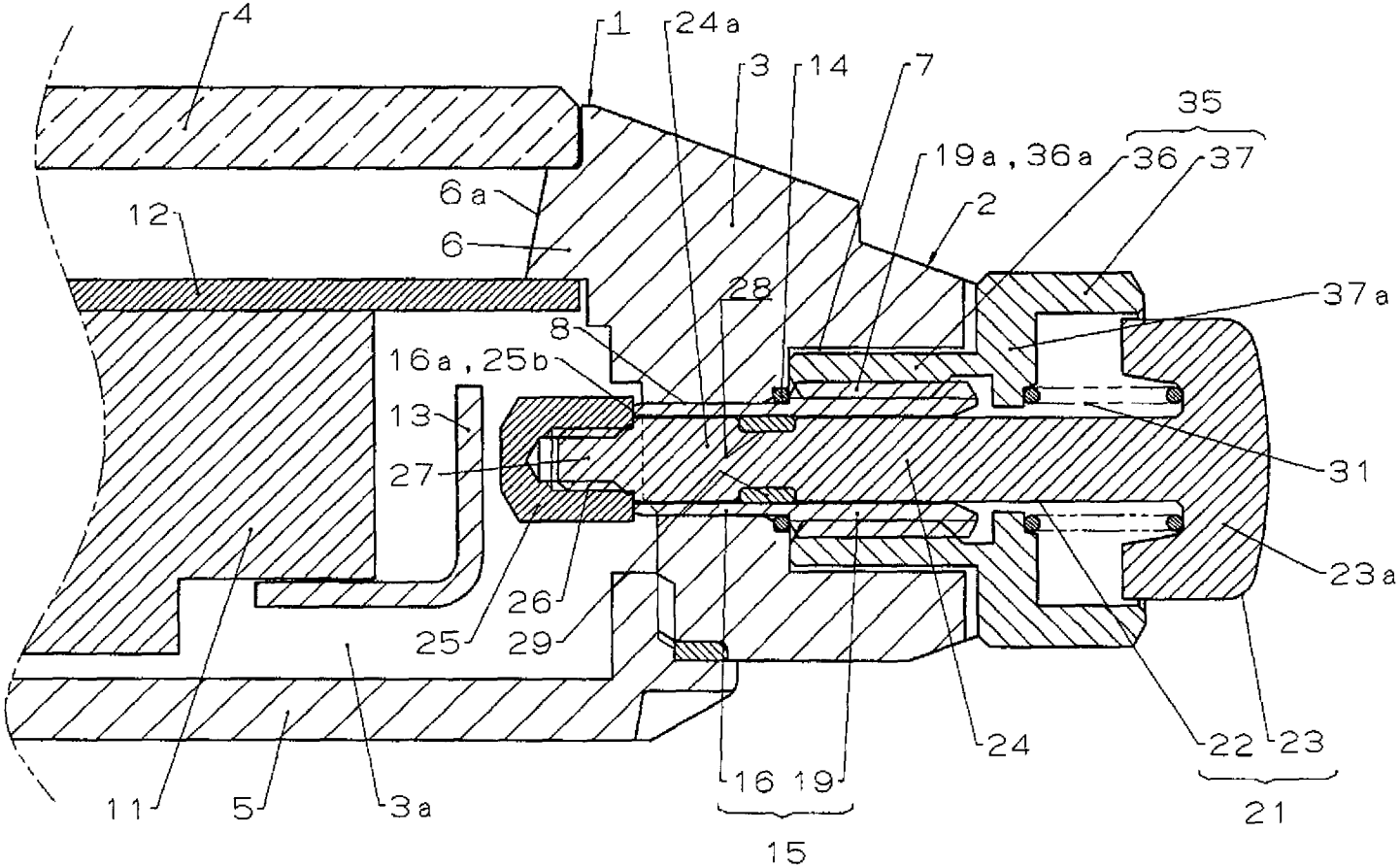
FIG. 7 is a cross-sectional view that shows a part of the wristwatch in a state in which a push button is placed in a button release position.

FIGS. 6 and 7 show a third embodiment of the present invention. The wristwatch according to the third embodiment is the same as the second embodiment except for a configuration described later. For that reason, the same configurations as those of the second embodiment are denoted by the same reference numerals as the second embodiment, and the descriptions thereof will be omitted.

In the third embodiment, the tip 16*a* of the insertion cylindrical portion 16 of the pipe 15 is protruded to the inner portion 3*a* of the body 3, and the engagement surface 25*b* of the second shaft portion 25 comes into contact with the tip 16*a* of the insertion cylindrical portion 16 by the inner portion 3*a* of the body 3.

By the configuration, it is possible to increase the diameter of the engagement surface 25*b* without being constrained to the diameter of the through hole 8 of the body 3. For this reason, it is possible to reliably engage the engagement surface 25*b* with the tip 16*a* of the insertion cylindrical portion 16 and take charge of the falling out stop of the push button 21 to the body 3 without being constrained to the irregularity in the size tolerance of the pipe 15 and the second shaft portion 25. Furthermore, in the third embodiment, the male screw portion 27 provided in the tip portion of the first shaft portion 24 may have the same diameter as the outer diameter of the first shaft portion 24 without being limited to the diameter smaller than the outer diameter of the first shaft portion 24. The configuration of the falling out stop in the third embodiment can also be applied to the first and second embodiments.

Furthermore, in the third embodiment, the concave portion 7 is opened only to the outer surface of the body 3. Furthermore, the wristwatch 1 of the third embodiment includes a lock mechanism to the push button 21. For that reason, a lock member 35 is adopted together with a configuration described below.

That is, the pipe 15 soldered to the body 3 is formed to have the insertion cylindrical portion 16 and the male screw cylindrical portion 19 that is integrally continued thereto and protruded into the concave portion 7. The inner diameters of the insertion cylindrical portion 16 and the male screw cylindrical portion 19 are identical to each other, and the inner surfaces of them are continued in the same plane. The outer diameter of the male screw cylindrical portion 19 is greater than the outer diameter of the insertion cylindrical portion 16, and the step portion of the outer periphery formed according to a difference in outer diameters is fixed by the solder material 14 so as to come into contact with the bottom surface of the concave portion 7. The male screw cylindrical portion 19 disposed outside the through hole 8 has the male screw portion 19*a* in the outer periphery thereof.

The lock member 35 has a screwed cylindrical portion 36 and a cover cylindrical portion 37 having a diameter greater than that, and forms a stepped cylindrical shape. The cylinder bottom wall portion 37*a* of the cover cylindrical portion 37 is integrally continued to the screwed cylindrical portion 36. A female screw portion 36*a* is formed in the inner periphery of the screwed cylindrical portion 36.

The lock member 35 screws the female screw portion 36*a* with the male screw portion 19*a* of the male screw cylindrical portion 19, and is provided movably along the axial direction of the pipe 15. By such a movement, the lock member 35 can be moved over a button release position coming into contact with the body 3, specifically, as shown in FIG. 7, a button release position where the screwed cylindrical portion 36 comes into contact with the bottom surface of the concave portion 7, and a button restriction position coming into contact with the head 23 of the push button 21, specifically, as shown in FIG. 6, a button restriction position where the cylinder bottom wall portion 37*a* comes into contact with the tip surface of the fitting cylindrical portion 23*a* of the head 23. In the state in which the lock member 35 is disposed in the button restriction position, the head 23 enters the cover cylindrical portion 37, and the peripheral surface of the head 23 is covered with the cover cylindrical portion 37.

Furthermore, the coil spring 31 is interposed between the cylinder bottom wall portion 37*a* of the lock member 35 screwed with and supported by the pipe 15 and the head 23 in a compressed state, and biases the push button 21 toward the outside of the body 3 by the spring force. Furthermore, the configuration provided with the lock mechanism mentioned above can also be applied to the first and second embodiments.

Other configurations except for those described above are the same as the second embodiment. For that reason, in the third embodiment, by the same reason described in the second embodiment in advance, the same action as the second embodiment is obtained, and the problem of the present invention can be solved. That is, it is possible to provide the wristwatch 1 which can suppress that the button shaft 22 of the push button 21 attached to the body 3 is deformed by impact, and can easily perform the attachment or detachment work of the push button 21 to or from the body 3.

Furthermore, in the third embodiment, since the lock function mentioned above is included, there is an advantage described below. That is, by rotating and operating the lock member 35 of the button release position shown in FIG. 7 in a predetermined direction by hands, it is possible to further protrude the lock member 35 to the outer direction of the body 3 and to place the same in the button restriction position by a change in engagement between the male screw portion 19*a* and the female screw portion 36*a*. Furthermore, in this case, the coil spring 31 is further compressed in the axial direction.

The lock member 35 placed in the button restriction position becomes a stopper, comes into contact with the head 23 from the body 3 side, and interferes with the pushing of the push button 21. Thus, even if the push button 21 is erroneously pushed while carrying the wristwatch 1, it is possible to prevent an operational error in which the push button 21 is accidently pushed.

However, the lock member 35 placed in the button restriction position is further rotated by a user. In this case, the rotation operation of the lock member 35 is performed by holding the cover cylindrical portion 37 by hands, but since the outer diameter of the cover cylindrical portion 37 covering the head 23 is relatively large, it is possible to relatively easily perform the rotation operation.

When the lock member 35 reached the button restriction position is further rotated in this manner, force acts on the push button 21 in a direction away from the body 3. The falling out stop of the push button 21 under the situation is realized by that fact that the engagement surface 25*b* of the second shaft portion 25 comes into contact with the tip 16*a* of the insertion cylindrical portion 16. For this reason, the second shaft portion 25 having the engagement surface 25*b* is not deformed by force acting in the falling out direction, and naturally, the second shat portion 25 does not enter the tip portion of the insertion cylindrical portion 16 having the small-diameter than that.

Particularly, since the overall second shaft portion 25 is removed from the through hole 8 and is placed in the inner portion 3*a* of the body 3, the diameter of the second shaft portion 25 can be greater than the diameter of the through hole 8 as shown in FIGS. 6 and 7 without being constrained to the through hole 8. For that reason, in the case of the configuration, there is no concern that the second shaft portion 25 does not enter the insertion cylindrical portion 16 having the diameter smaller than that.

Thus, as described later, it is possible to ensure the operation reliability of the push button 21 in the state of returning the lock member 35 back to the button release position.

Furthermore, describing for comparison, the portable timepiece described in Patent Reference 1 includes a screw lock mechanism in which the female screw portion formed in the inner periphery of the lock member is screwed with the male screw portion formed in the outer periphery of the pipe attached to the body, and the lock member is provided movably over the button restriction position and the button release position by a change in screwed positions of the screw portion. Thus, it is possible to prevent that the push button is accidently pushed in the state in which the lock member is placed in the button restriction position like the third embodiment. However, when a user continuously rotates and operates the lock member in the state of placing the lock member in the button restriction position, force in a direction drawn from the body acts on the push button, along with this, excessive force is applied to the snap ring attached to the push button, and the snap ring is deformed toward the outside of the body so as to become a conical shape and is cut into the body inner end portion of the pipe. In such a case, it is difficult to detach the snap ring from the pipe, which leads to a situation that damages an overhaul. Furthermore, there is a concern that a pushing error may be generated in which, even if not leading to such a situation, even when pushing the push button after returning the lock member to the button release position, it is difficult to push the push button.

Furthermore, in the case of operating the push button 21 in the wristwatch 1 of the third embodiment, firstly, by rotating the lock member 35 placed in the button restriction position in a reverse direction, by a change in engagement between the male screw portion 19*a* and the female screw portion 36*a*, the lock member 35 of the button restriction position is moved in a direction approaching the body 3 and is placed in the button release position shown in FIG. 7. Furthermore, in this case, the coil spring 31 is extended. Furthermore, the cylinder bottom wall portion 37*a* of the lock member 35 placed in the button release position is separated from the tip of the fitting cylindrical portion 23*a* of the head 23. For that reason, as the head 23 of the push button 21 is pushed, since the push button 21 is pushed toward the inner portion of the body 3 while compressing the coil spring 31, the contact member 13 of the movement 11 can suitably be pushed by the tip thereof.

The present invention is not limited to the respective embodiments mentioned above. For example, the present invention can also be applied to a pocket watch in addition to the wristwatch.

What is claimed is:

1. A portable timepiece comprising:

a module that has a contact member;

a timepiece exterior assembly which has a body formed with a through hole and in which the module is accommodated;

a pipe that has an insertion cylindrical portion and is fixed to the body by inserting the insertion cylindrical portion into the through hole;

a push button that has a button shaft which can approach and be separated from the contact member through the pipe, and a push operation head which is continued to the shaft and is placed outside the body, in which the button shaft is formed with by screwing a second shaft portion having a diameter lager than that of a first shaft portion and having an engagement surface capable of approaching and being separated from a tip of the insertion cylindrical portion into the first shaft portion formed integrally with the head; and a biasing member that is provided so as to bias the push button toward the outside of the body so that the engagement surface is held in a state of coming into contact with the tip of the insertion cylindrical portion.

2. The portable timepiece according to claim 1, wherein at least a pair of planes is formed on a peripheral surface of the second shaft portion.

3. The portable timepiece according to claim 1, wherein the tip portion of the insertion cylindrical portion is protruded into an inner portion of the body, and the engagement surface of the second shaft portion is held in contact with the tip of the insertion cylindrical portion in the inner portion of the body by the biasing force of the biasing member.

4. The portable timepiece according to claim 1, wherein the first shaft portion has a packing attachment groove in an outer peripheral portion thereof, an annular water-proof packing coming into contact with an inner peripheral surface of the insertion cylindrical portion is fitted to the packing attachment groove and is attached to the first shaft portion, the first shaft portion has a male screw part of a diameter smaller than that of an outer diameter thereof, the second shaft portion has a female screw part, and the first shaft portion and the second shaft portion are connected to each other by screwing the male screw part with the female screw part.

5. The portable timepiece according to claim 1, wherein the pipe has a large-diameter cylindrical portion that has a diameter larger than that of the insertion cylindrical portion, is integrally continued to the insertion cylindrical portion, and is placed outside the body, the head is fitted to the large-diameter cylindrical portion, and the biasing member is interposed between a cylinder bottom wall portion of the large-diameter cylindrical portion and the head in a compressed state.

6. The portable timepiece according to claim 1, wherein the pipe has a male screw cylindrical portion which is placed outside the through hole so as to be integrally continued to the insertion cylindrical portion and is formed with a male screw in an outer periphery thereof, the pipe further includes a lock member that is placed over a button release position which is screwed with the male screw cylindrical portion movably along an axial direction of the pipe and comes into contact with the body and a button restriction position which comes into contact with the head, the lock member has a cover cylindrical portion that covers a peripheral surface of the head in the button restriction position, and the biasing member is interposed between the head and the lock member in a compressed state.

* * * * *